US008511772B2

(12) United States Patent
Ishihara

(10) Patent No.: US 8,511,772 B2
(45) Date of Patent: Aug. 20, 2013

(54) PRINTING DEVICE AND PRINTING METHOD

(75) Inventor: Kenichi Ishihara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 34 days.

(21) Appl. No.: 13/293,578

(22) Filed: Nov. 10, 2011

(65) Prior Publication Data

US 2012/0139980 A1 Jun. 7, 2012

(30) Foreign Application Priority Data

Nov. 12, 2010 (JP) ..... 2010-254135

(51) Int. Cl.
*B41J 29/38* (2006.01)

(52) U.S. Cl.
USPC ..... 347/9

(58) Field of Classification Search
CPC . B41J 2/04505; B41J 2/04508; B41J 2/04516
USPC ..... 347/9–12, 15, 40
See application file for complete search history.

(56) References Cited

FOREIGN PATENT DOCUMENTS

JP 2002-225305 A 8/2002

*Primary Examiner* — An Do
(74) *Attorney, Agent, or Firm* — Global IP Counselors, LLP

(57) ABSTRACT

To suppress nozzle clogging without reducing printing speed, a printing device of the invention includes a plurality of nozzles for discharging ink while moving in a movement direction; a conveying unit for conveying a medium in a conveying direction; and a controller for repeating a dot-forming action for discharging ink from the nozzles moving in the movement direction and forming dots on the medium, and a conveying action for conveying the medium in the conveying direction. The controller places an additional image in a different position in the movement direction from an area where a main image to be printed is formed, discharges ink from all of the nozzles in each of the dot-forming actions, and prints the additional image on the medium.

7 Claims, 9 Drawing Sheets

PRINTING DEVICE AND PRINTING METHOD

CROSS-REFERENCE TO RELATED APPLICATIONS

This application claims priority to Japanese Patent Application No. 2010-254135 filed on Nov. 12, 2010. The entire disclosure of Japanese Patent Application No. 2010-254135 is hereby incorporated herein by reference.

TECHNOLOGICAL FIELD

The present invention relates to a printing device and a printing method.

BACKGROUND TECHNOLOGY

There are known inkjet printers which discharge ink onto paper, cloth, film, and other media. In such inkjet printers, the ink in the nozzles sometimes evaporates, causing the ink in the nozzles to become viscous and clog the nozzles. In view of this, a flushing action is performed in inkjet printers in which ink is discharged (a check discharge) from the nozzles outside of the printing area, where ink is not deposited on the medium.

Japanese Laid-open Patent Publication No. 2002-225305 (Patent Citation 1) discloses such inkjet printers for example.

SUMMARY

Problems to be Solved by the Invention

Depending on the content of the image being printed, sometimes ink is not necessarily discharged from all of the nozzles during printing and ink is not discharged from some of the nozzles. If ink continues to not be discharged, the ink in the nozzles becomes more viscous even during printing, which causes nozzle clogging. Therefore, even during printing, a flushing action is performed periodically for the purpose of preventing the ink from becoming more viscous.

When the flushing action is performed during printing, a problem is encountered in that the printing action must be halted and the printing speed decreases.

In view of this, an advantage of the invention is to suppress nozzle clogging without reducing printing speed.

Means Used to Solve the Above-Mentioned Problems

The invention for achieving the advantage described above is a printing device including a plurality of nozzles for discharging ink while moving in a movement direction; a conveying unit for conveying a medium in a conveying direction; and a controller for repeating a dot-forming action for discharging ink from the nozzles moving in the movement direction and forming dots on the medium, and a conveying action for conveying the medium in the conveying direction; the printing device characterized in that: the controller places an additional image in a different position in the movement direction from an area where a main image to be printed is formed, discharges ink from all of the nozzles in each of the dot-forming actions, and prints the additional image on the medium.

Other characteristics of the invention will be made clear in the present specification and descriptions of the accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
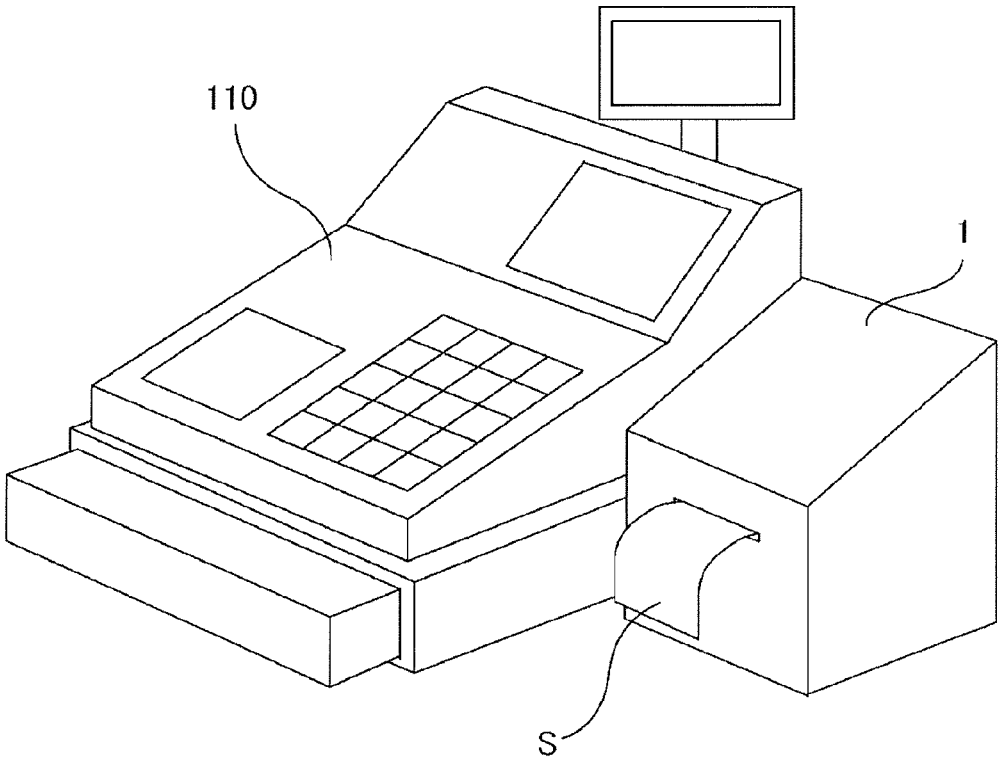
FIG. 1 is an explanatory drawing of the overall configuration.

At least the following matters are made clear by the present specification and the descriptions of the accompanying drawings.

A printing device is disclosed which includes a plurality of nozzles for discharging ink while moving in a movement direction; a conveying unit for conveying a medium in a conveying direction; and a controller for repeating a dot-forming action for discharging ink from the nozzles moving in the movement direction and forming dots on the medium, and a conveying action for conveying the medium in the conveying direction; the printing device characterized in that: the controller places an additional image in a different position in the movement direction from an area where a main image to be printed is formed, discharges ink from all of the nozzles in each of the dot-forming actions, and prints the additional image on the medium.

According to such a printing device, nozzle clogging can be suppressed without reducing the printing speed.

Preferably, the controller places the additional image around a periphery of the main image. Ink is thereby discharged from the nozzles in order to print the additional image before the main image is printed, and nozzle clogging during main image printing can therefore be suppressed.

Preferably, the additional image includes a character row between line spaces a, and a width t of the additional image in the movement direction and an incline θ of the character rows relative to the movement direction have the relationship $a<t \sin \theta$. It is thereby possible to avoid instances in which the same nozzles are always positioned between the lines during additional image printing.

Preferably, a plurality of nozzles are provided for individual colors, and the inks of each of the colors are mixed and the additional image is printed before the main image is printed. Clogging of the nozzles of every color can thereby be suppressed.

Preferably, before the main image is printed, the dot-forming action is performed a plurality of times and the additional images are overlappingly printed. Pre-printing flushing can thereby be omitted.

Preferably, the additional image is an image drawn in ink using densely spaced dots. The additional image, formed by overlapping printings, thereby has a less noticeable concentration.

A printing method is disclosed wherein: there are used a plurality of nozzles for discharging ink while moving in a movement direction, and a conveying unit for conveying a medium in a conveying direction; and there are repeated a dot-forming action for discharging ink from the nozzles moving in the movement direction and forming dots on the medium, and a conveying action for conveying the medium in the conveying direction; the printing method characterized in that: an additional image is placed in a different position in the movement direction from an area where a main image to be printed is formed, ink is discharged from all of the nozzles in each of the dot-forming actions, and the additional image is printed on the medium.

According to such a printing method, nozzle clogging can be suppressed without reducing printing speed.

First Embodiment

Overall Configuration

FIG. 1 is an explanatory drawing of the overall configuration.

A cash calculator 110 shown in FIG. 1 is installed in the cash register of a supermarket. A printer 1 for printing receipts and coupons is installed on the side of the cash calculator 110. The printer 1 is connected to the cash calculator 110, and the printer 1 prints a receipt S, for example, according to print data from the cash calculator 110.

Figure 2:
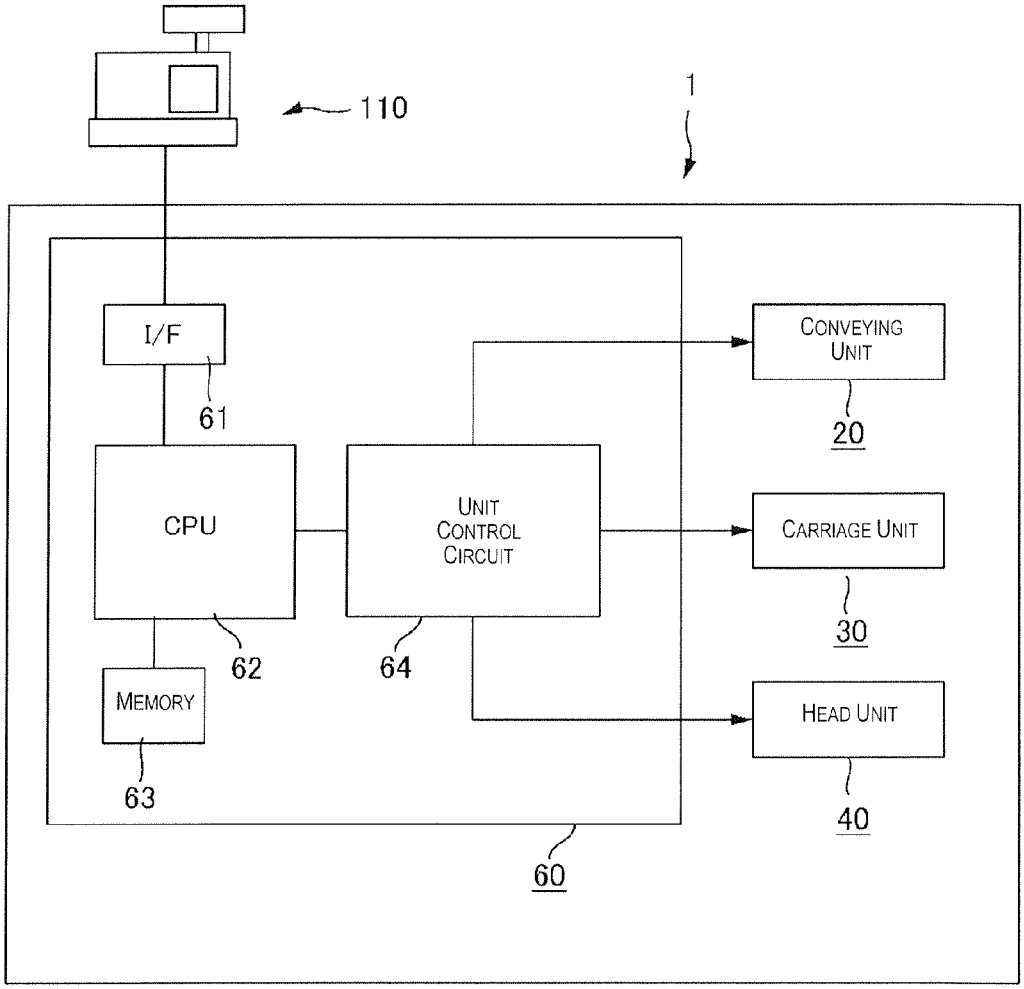
FIG. 2 is a block diagram of the overall configuration of a printer.
Figure 3:
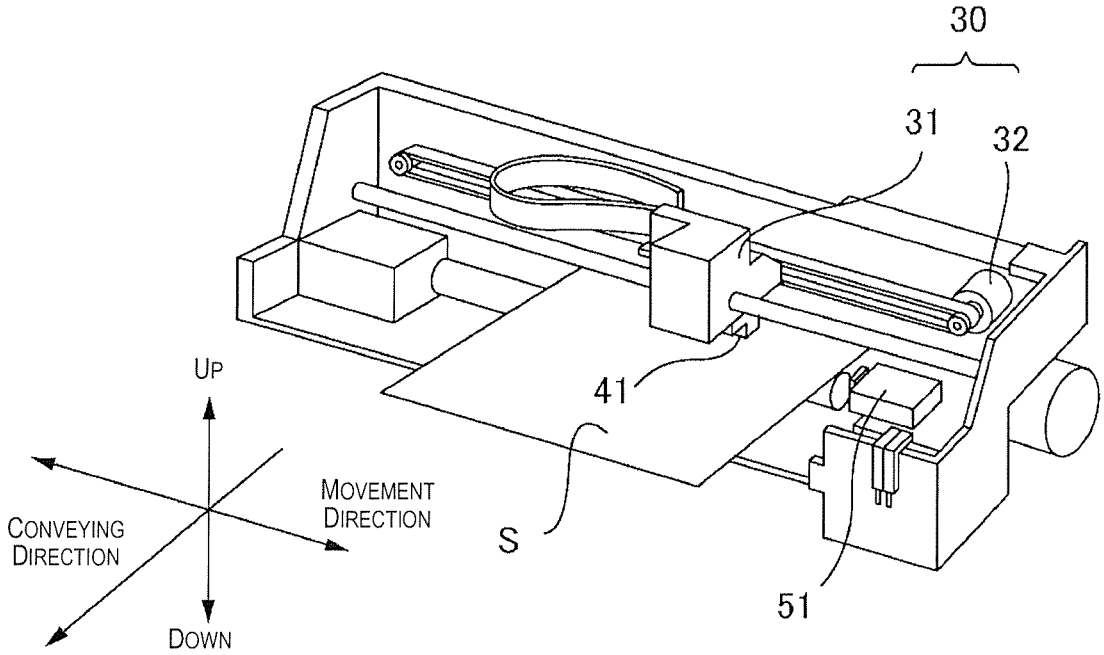
FIG. 3 is a schematic drawing of the internal configuration of a printer.

FIG. 2 is a block diagram of the overall configuration of the printer. FIG. 3 is a schematic drawing of the internal configuration of the printer.

The printer has a conveying unit 20, a carriage unit 30, a head unit 40, and a controller 60. Having received print data from the cash calculator 110, the printer 1 controls the other units (the conveying unit 20, the carriage unit 30, the head unit 40) through the controller 60. Based on print data received from the cash calculator 110, the controller 60 controls the other units and forms an image on paper. The conditions within the printer 1 are observed by a detector group (not shown), and the controller 60, having received detection results from the detector group, controls the other units on the basis of the detection results.

The purpose of the conveying unit 20 is to feed the medium (e.g. paper S or the like) to a position where printing can be performed and to convey the medium by a predetermined conveyed amount in a predetermined direction (referred to hereinbelow as the conveying direction) during printing. The conveying unit 20 conveys the paper by causing a conveying roller to rotate using a conveying motor.

The purpose of the carriage unit 30 is to move (scan) the head in a predetermined direction (referred to hereinbelow as the movement direction). The carriage unit 30 has a carriage 31 and a carriage motor 32 (also referred to as a CR motor) for moving the carriage 31. The carriage 31 is capable of moving back and forth in a movement direction (the head thereby moves along the movement direction).

The purpose of the head unit 40 is to discharge ink onto the paper. The head unit 40 has a head 41. The head 41 has a plurality of nozzles which are ink discharge components, and ink is discharged intermittently from the nozzles. The head 41 is provided to the carriage 31. Therefore, when the carriage 31 moves in the movement direction, the head 41 also moves in the movement direction. An image is formed on the paper by the head 41 intermittently discharging ink while moving in the movement direction.

Figure 4:
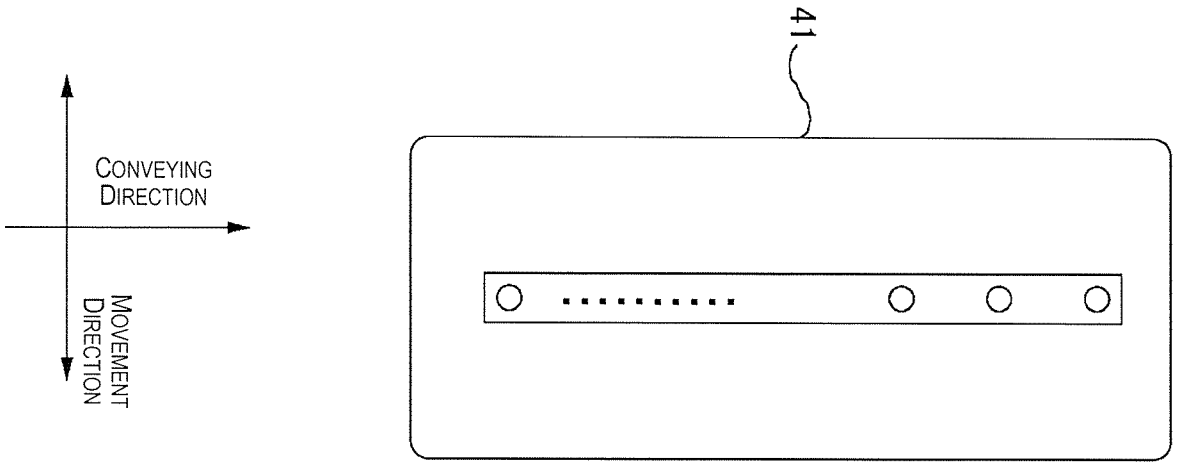
FIG. 4 is an explanatory drawing of the bottom surface of a head of the first embodiment.

FIG. 4 is an explanatory drawing of the bottom surface of the head of the first embodiment. A nozzle row for discharging black ink is provided on the bottom surface of the head. A plurality of nozzles are aligned in the nozzle row at a predetermined nozzle pitch along the conveying direction.

The controller 60 is a control unit for controlling the printer. The controller 60 has an interface 61, a CPU 62, a memory 63, and a unit control circuit 64. The interface 61 conducts the exchange of data between the cash calculator 110 and the printer 1. The CPU 62 is a calculating and processing device for controlling the entire printer. The purpose of the memory 63 is to ensure there are areas for storing the programs of the CPU 62, operating areas, and the like; and the memory 63 has RAM, EEPROM, and other storage devices. The CPU 62 controls the other units via the unit control circuit 64 according to the programs stored in the memory 63.

When an image is printed on the paper, the controller 60 moves the carriage in the movement direction, and alternately repeats a dot-forming action (also called a pass) for discharging ink from the moving head and forming dots on the paper, and a conveying action for conveying the paper in the conveying direction. An image composed of dots is thereby printed on the paper.

An ink recovery component 51 is provided to the outer side of the print area as shown in FIG. 3. The ink recovery component 51 is a member for recovering ink discharged from the head 41 during the flushing action. The flushing action is an action for discharging (a check discharge) ink from the head outside of the print area in order to suppress nozzle clogging. As will be described hereinafter, according to the printing method of the present embodiment, the number of times the flushing action is performed can be reduced.

Printing Action of Reference Example

Figure 5:
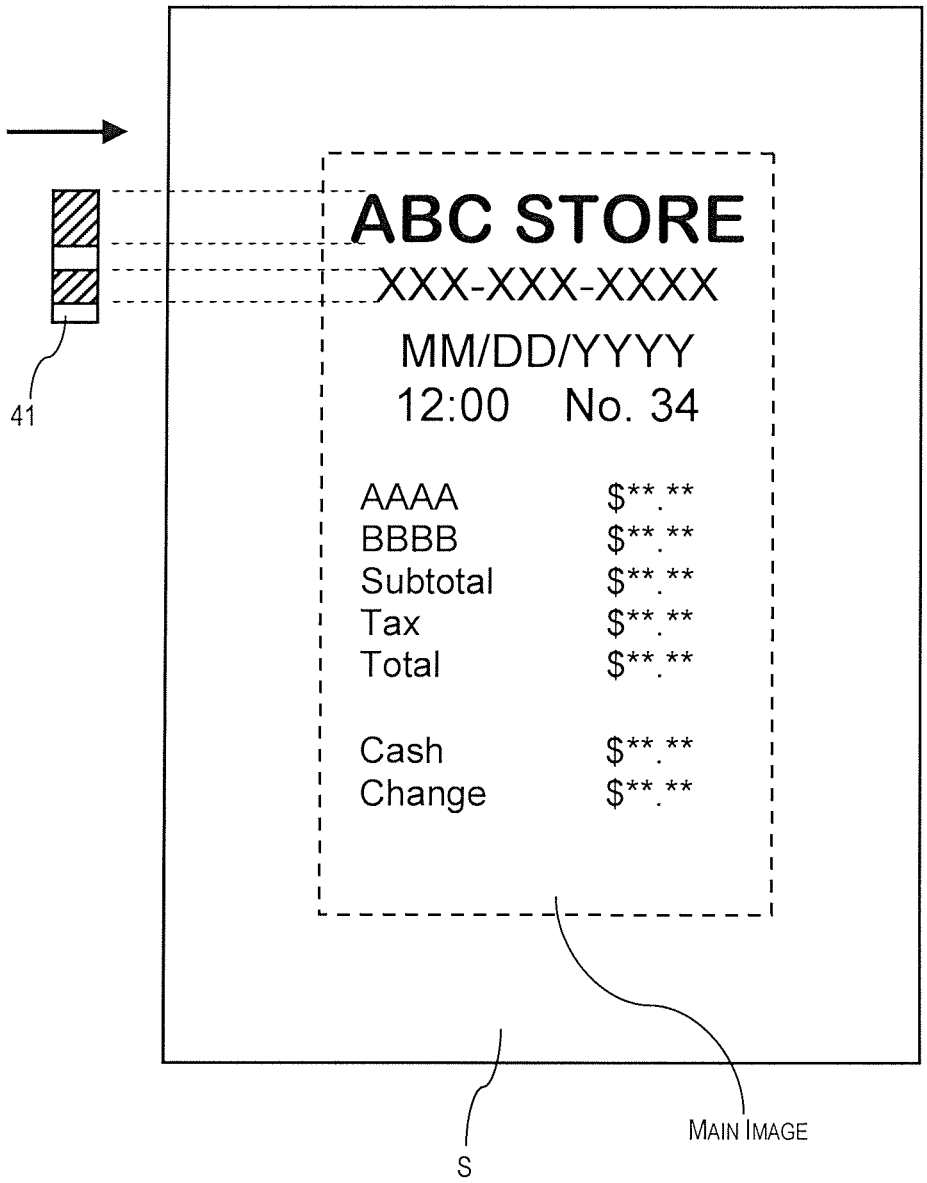
FIG. 5 is an explanatory drawing of the printing action on a receipt as a reference example.

FIG. 5 is an explanatory drawing of a printing action on a receipt in a reference example.

In the reference example, a main image is printed on paper, leaving white space. The main image contains, for example, images of a store name, a phone number, a date, a time, a register number, product names, money amounts, and the like. When a receipt is printed, the image (the main image) being printed on the paper is a text image composed primarily of characters. When text images are printed, line space is often left between the character rows in order to make the text easier to read.

In cases in which the head prints a certain text image in line space, the nozzles positioned over the line space do not discharge ink. For example, in the pass shown in the drawing, when the head prints text images of the store name and phone number while moving, the nozzles positioned in the diagonal line areas in the drawing discharge ink during this pass, but the nozzles outside of the diagonal line areas (nozzles positioned between the store name and phone number, and nozzles positioned upstream in the conveying direction from the phone number) do not discharge ink.

When ink continues to not be discharged for a long period of time, the ink in the nozzles becomes more viscous, and there is a risk of the nozzles being clogged. Nozzle clogging can be suppressed when the flushing action is performed periodically during printing, but the printing speed decreases because during printing, the head 41 is temporarily moved to the ink recovery component 51 outside of the print area, ink is forcefully discharged from the nozzles to the ink recovery component 51, and other actions are performed.

Printing Action of First Embodiment

Figure 6:
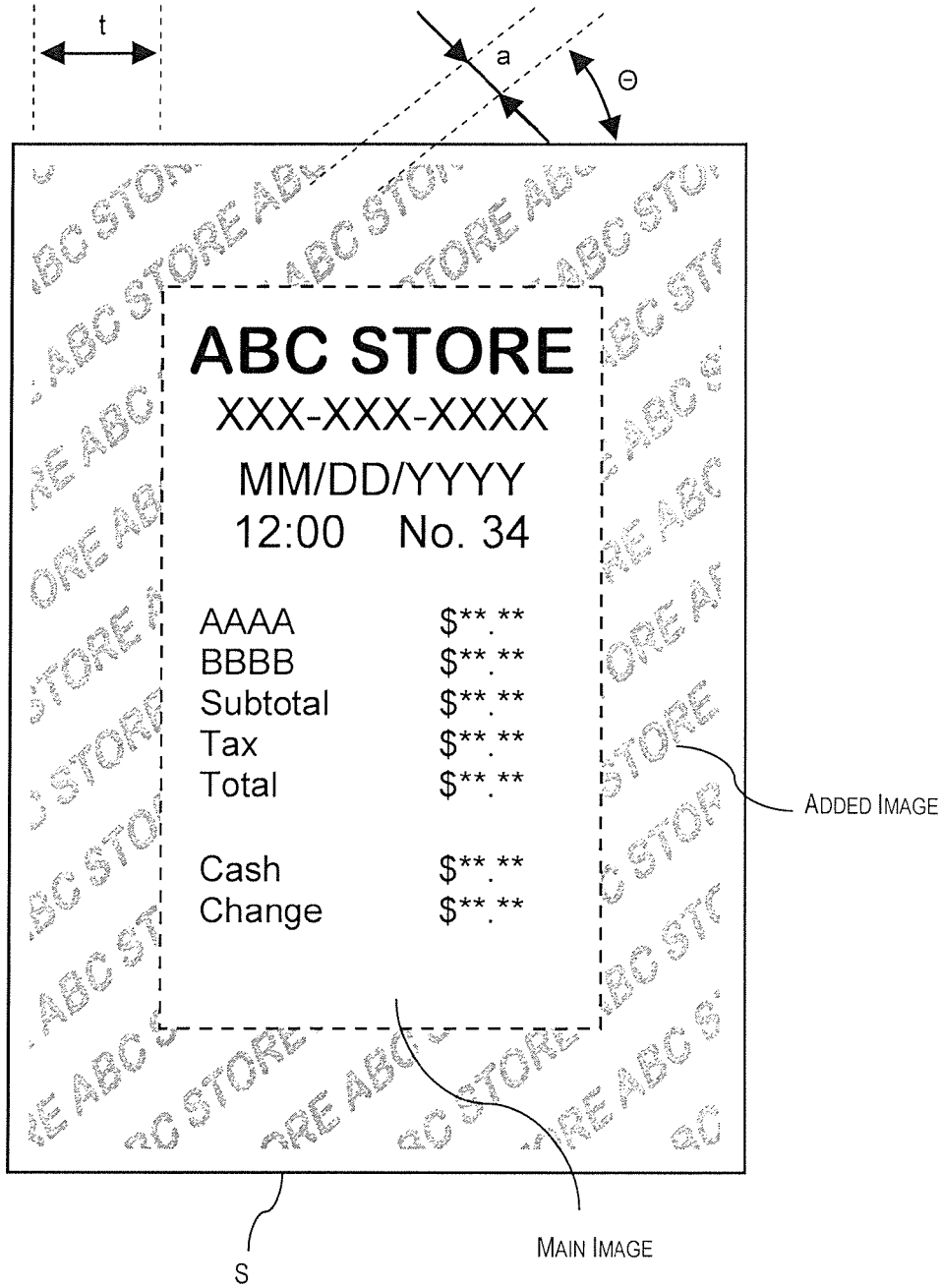
FIG. 6 is an explanatory drawing of the printing action on a receipt of the first embodiment.

FIG. 6 is an explanatory drawing of the printing action on a receipt in the first embodiment.

When the controller 60 of the printer 1 receives print data instructing printing of the main image in FIG. 5 from the cash calculator 110, the controller 60 reaches additional image data stored in the memory 63. The controller 60 then creates image data in which an additional image is placed so as to encircle the periphery of the main image, as shown in FIG. 6. The printer 1 then prints the main image and the additional image on the basis of the image data in which the additional image is placed. The additional image is formed in a position in the movement direction that is different from the area in which the main image is formed.

The additional image is an image of the store name placed diagonally. Therefore, the line spaces between the character rows are also diagonal. Therefore, the nozzles positioned over line spaces change if the head moves, and this state of the same nozzles not discharging ink therefore ceases. As a result, when an additional image is printed, ink will be discharged from all of the nozzles. The term "all of the nozzles" used herein refers to nozzles capable of discharging ink and excludes dummy nozzles which do not discharge ink.

In other words, the additional image stored in the memory 63 contains character rows placed diagonally so that ink is discharged from all of the nozzles. When the width of each additional image to the left and right of the main image is denoted by t, the line space between character rows of the additional image is denoted by a, and the incline of the character rows relative to the movement direction of the head 41 is denoted by θ, these parameters preferably have a relationship of for example, $a<t \sin \theta$. If this relationship is true, it is possible to prevent the same nozzles from being constantly positioned over line spaces while the head is printing each additional image to the left and right of the main image. If ink is discharged from all of the nozzles by printing the additional image, the relationship $a<t \sin \theta$ need not hold true.

Since such an additional image is placed so as to encircle the periphery of the main image, the head 41 prints the additional image in each pass. Therefore, ink is discharged from all of the nozzles in each pass. As a result, there are no nozzles in which ink continues to not be discharged for a long period of time during printing, and the flushing action need not be performed periodically during printing.

To enable the user to adjust the rate of ink consumption, it is preferable to allow the concentration of the additional image to be adjusted. To prevent the concentration of the main image from decreasing when the concentration of the additional image decreases, the controller 60 preferably adjusts the concentration of the additional image separately from that of the main image.

Second Embodiment

In the previously described embodiment, the head has only a nozzle row for discharging black ink. The user may wish to print the main image (particularly the store name of the main image) in color. In view of this, the printer of the second embodiment has a configuration capable of color printing.

Figure 7:
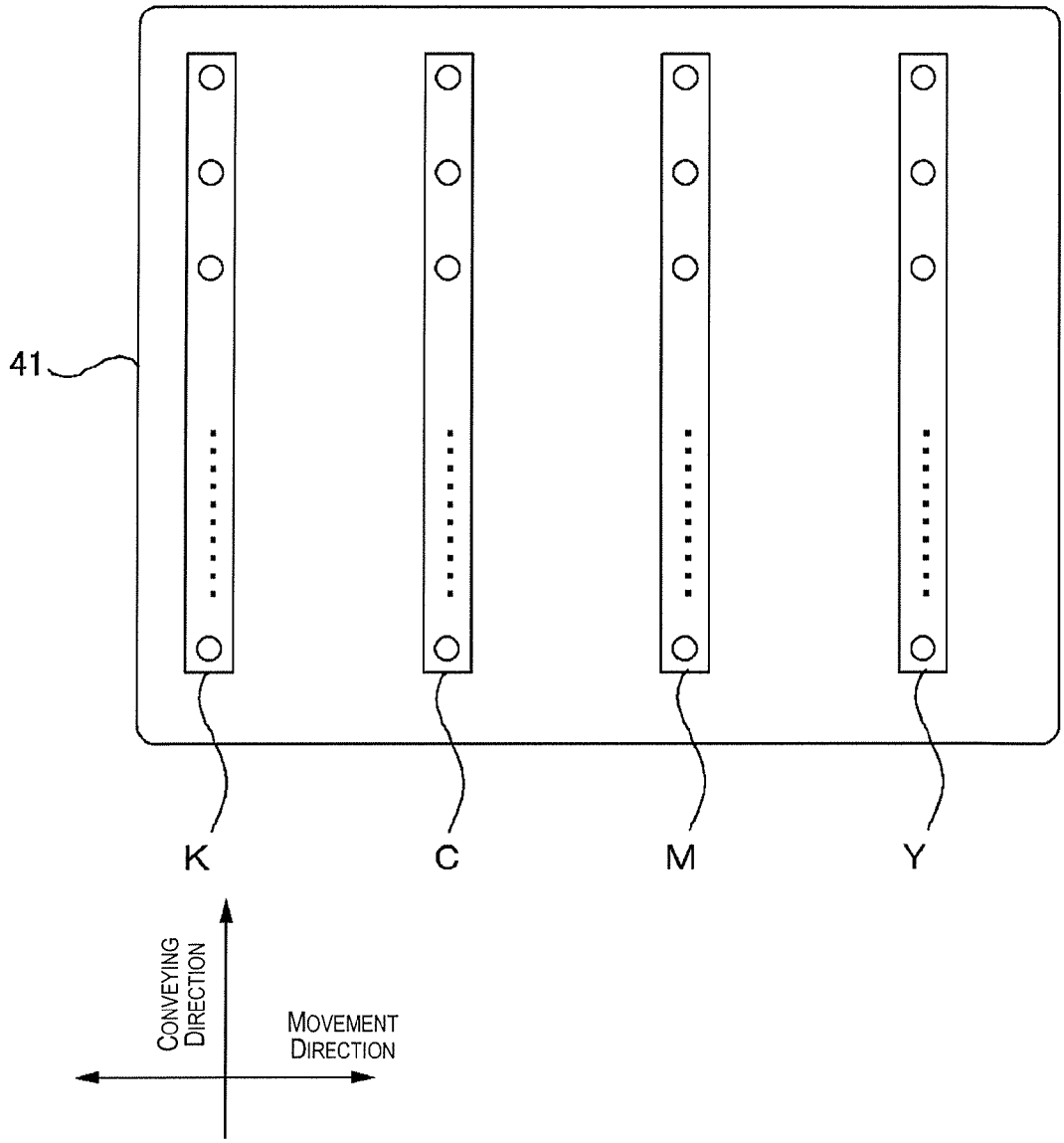
FIG. 7 is an explanatory drawing of the bottom surface of a head of the second embodiment.

FIG. 7 is an explanatory drawing of the bottom surface of the head of the second embodiment. The bottom surface of the head of the second embodiment is provided not only with a black nozzle row, but also with a cyan nozzle row, a magenta nozzle row, and a yellow nozzle row. In each of the nozzle rows, a plurality of nozzles are aligned at a predetermined nozzle pitch along the conveying direction.

Figure 8:
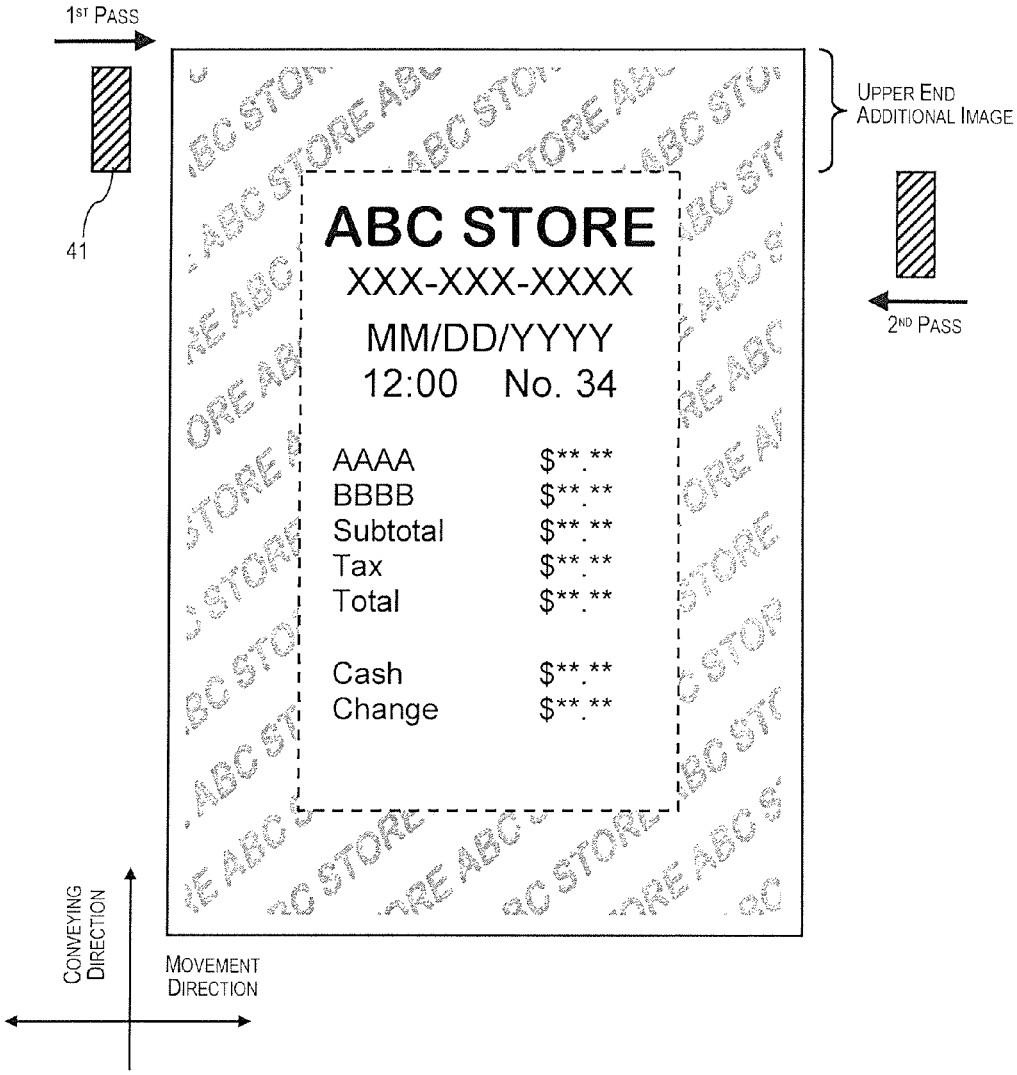
FIG. 8 is an explanatory drawing of the printing action on a receipt of the second embodiment.

FIG. 8 is an explanatory drawing of the printing action on a receipt in the second embodiment. The additional image is a black image.

If a black additional image is printed in only black ink, nozzle clogging of the black nozzle row can be suppressed, but nozzle clogging of the color nozzle rows (the cyan nozzle row, the magenta nozzle row, and the yellow nozzle row) cannot be suppressed.

In view of this, in the second embodiment, black additional images are formed by mixing dots of all the ink colors. Specifically, black additional images are formed by composite black. Ink is thereby discharged from all the nozzles in each pass. As a result, the flushing action need not be performed periodically during printing because there are no nozzles which continue to not discharge ink for a long period of time during printing.

Modification

If all of the additional images are formed by composite black, more color ink is consumed, which is costlier than black ink. In cases in which only part of the main image (e.g., only the store name of the main image) is a color image and the rest of the image is a monochrome image, if color nozzle clogging can be suppressed immediately before the color image is printed, it is believed the image quality is not affected even if the ink in the color nozzles becomes somewhat more viscous after the color image is printed.

In view of this, the upper end additional image printed in the first pass in FIG. 8 may be printed by composite black, and the additional images thereafter may be printed by black ink alone. If printing is done in this manner, nozzle clogging is suppressed when the store image, which is a color image, is printed in the second pass. If the additional images other than the upper end additional image (the image upstream in the conveying direction from the upper end additional image, the additional image printed after the upper end additional image is printed) are printed from black ink alone, the consumption of color ink can be reduced.

Third Embodiment

Since the nozzles continue to be unused while the printer 1 is not being used, the flushing action is sometimes performed before the first pass when printing starts. In the following description, the flushing action before the first pass is referred to as the "pre-printing flushing action."

When the pre-printing flushing action is performed, the start of printing is delayed, and the printing time duration until the completion of printing is longer. In view of this, in the third embodiment, the pre-printing flushing action is omitted and the printing time duration is reduced.

Figure 9:
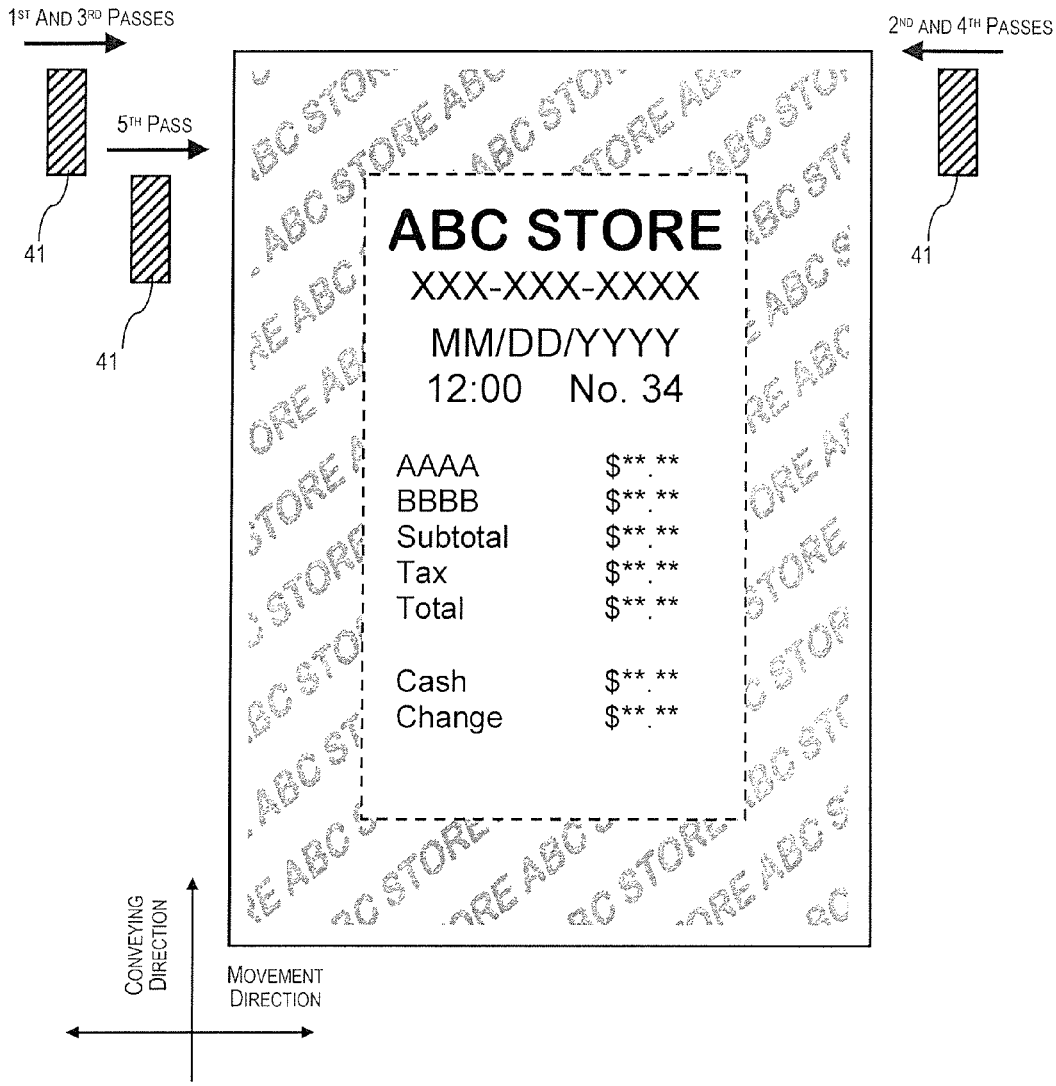
FIG. 9 is an explanatory drawing of the printing action on a receipt of the third embodiment.

FIG. 9 is an explanatory drawing of the printing action on a receipt in the third embodiment. In a usual printing action, a conveying action is performed for conveying the paper between passes, but in the third embodiment, the conveying action is not performed between the first through fourth passes.

First, the upper end additional image is printed in the first pass. Since there are nozzles that continue to be unused, some of the nozzles become clogged, and the ink is either not discharged from these nozzles, or, even if the ink is discharged it is discharged in a small amount. As a result, the upper end additional image printed in the first pass is an image of the lower than usual concentration.

After the first pass, the controller 60 performs the second pass without conveying the paper. Therefore, in the second pass, the printing of the upper end additional image is overlapped. Since the action of discharging ink is performed in the first pass, nozzle clogging is alleviated more in the second pass than in the first pass. Thus, nozzle clogging is gradually alleviated with every pass until the fourth pass. The upper end additional image made fainter in the first pass is printed darker after the fourth pass.

In the present embodiment, the additional image is preferably an image drawn out with ink by densely spacing the dots. This is because if the additional image is drawn in this manner, it is difficult to visually ascertain the concentration of the upper end additional image even if the upper end additional image is printed with a greater amount of ink than the usual additional image by double-printing the upper end additional image.

When the fourth pass has ended, the action of discharging ink is performed any number of times in all of the nozzles, and nozzle clogging is therefore alleviated in the same manner as after the pre-printing flushing action is performed.

In view of this, after the fourth pass, the controller 60 performs the conveying action of conveying the paper in the conveying direction and performs the fifth pass. From the fifth pass onward, the printing action is performed in the same manner as usual printing.

According to the third embodiment, the printing time duration can be shortened because the pre-printing flushing action is omitted.

Other Embodiments

The embodiments described above are intended to make the invention easier to understand and should not be interpreted as limiting the invention. The invention can be modified and improved without deviating from the scope thereof, and such equivalents and the like are of course included in the invention. The embodiments described hereinbelow in particular are included in the invention.

Printer

The printer of the previous embodiments is connected to a financial calculator and printed primarily receipts. However, the printer is not limited to this example. If the printer is prone to the problem of nozzle clogging, the previous embodiments can be applied.

The Additional Image

According to the previous embodiments, the additional image is a text image of a store name. However, the additional image is not limited to this example. The additional image may, for example, be another text image such as the word "CONFIDENTIAL," or an image other than a text image.

According to the previous embodiments, the additional image is placed so as to encircle the periphery of the main image. However, the placement of the additional image is not limited to this example if ink is discharged from all of the nozzles in each pass. For example, the additional image may be placed only to the left and right of the main image (in positions adjacent in the head movement direction, or in other words in different positions in the movement direction from the area where the main image is formed), or the additional image may be not placed upstream or downstream in the conveying direction from the main image. The additional image may also be placed to only one side of the main image instead of being placed to both the left and right sides of the main image.

If the additional image is arranged around the periphery of the main image, ink is discharged from the nozzles in order to print the additional image before the main image is printed, which therefore has the effect of making it possible to suppress nozzle clogging during printing of the main image.

General Interpretation of Terms

In understanding the scope of the invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the invention, it will be apparent to those skilled in the art from this disclosure that various changes and modifications can be made herein without departing from the scope of the invention as defined in the appended claims. Furthermore, the foregoing descriptions of the embodiments according to the invention are provided for illustration only, and not for the purpose of limiting the invention as defined by the appended claims and their equivalents.

What is claimed is:

1. A printing device comprising:

a plurality of nozzles for discharging ink while moving in a movement direction;

a conveying unit for conveying a medium in a conveying direction; and a controller for repeating a dot-forming action for discharging ink from the nozzles moving in the movement direction and forming dots on the medium, and a conveying action for conveying the medium in the conveying direction;

the controller placing an additional image in a different position in the movement direction from an area where a main image to be printed is formed, discharges ink from all of the nozzles in each of the dot-forming actions, and prints the additional image on the medium, the additional image including at least two character rows that have a line space therebetween, the character rows being printed on the medium diagonally with respect to the movement direction.

2. The printing device according to claim 1, wherein the controller places the additional image encircling a periphery of the main image.

3. The printing device according to claim 1, wherein a width t of the additional image in the movement direction and an incline θ of the character row relative to the movement direction have the relationship:

$a<t \sin \theta$.

4. The printing device according to claim 1, wherein a plurality of nozzles are provided for individual colors; and the inks of each of the colors are mixed and the additional image is printed before the main image is printed.

5. The printing device according to claim 1, wherein before the main image is printed, the dot-forming action is performed a plurality of times and the additional images are overlappingly printed.

6. The printing device according to claim 5, wherein the additional image is an image drawn in ink using densely spaced dots.

7. A printing method comprising:

a plurality of nozzles for discharging ink while moving in a movement direction, and a conveying unit for conveying a medium in a conveying direction; and there are repeated a dot-forming action for discharging ink from the nozzles moving in the movement direction and forming dots on the medium, and a conveying action for conveying the medium in the conveying direction;

an additional image being placed in a different position in the movement direction from an area where a main image to be printed is formed, ink is discharged from all of the nozzles in each of the dot-forming actions, and the additional image is printed on the medium, the additional image including at least two character rows that have a line space therebetween, the character rows being printed on the medium diagonally with respect to the movement direction.

* * * * *